United States Patent [19]

Tomaro

[11] 3,937,232

[45] Feb. 10, 1976

[54] LIQUID FEEDING MEANS FOR STEAM-PRODUCING APPLIANCE

[75] Inventor: Patrick M. Tomaro, Maplewood, N.J.

[73] Assignee: Continental Hair Products, Inc., Edison, N.J.

[22] Filed: Jan. 29, 1975

[21] Appl. No.: 545,059

[52] U.S. Cl. ..... 132/37 R; 219/222

[51] Int. Cl.[2] ..... A45D 2/24

[58] Field of Search ..... 132/37 R, 36 R; 219/274; 239/43, 45, 145

[56] References Cited

UNITED STATES PATENTS 2,779,962 2/1957 Cooper ..... 239/145 X 3,835,292 9/1974 Walter ..... 132/37 R

*Primary Examiner*—G. E. McNeill

*Attorney, Agent, or Firm*—Alan H. Levine

[57] ABSTRACT

A liquid feeding means including a reservoir for a liquid and a wick of absorbent material within the reservoir. A portion of the wick is exposed exteriorly of the reservoir for engagement by a heated element so as to produce steam. A tube having an inside diameter of capillary size is embedded in the wick and extends from its exposed portion toward the reservoir to transmit air into the reservoir as water from the reservoir is converted to steam.

6 Claims, 5 Drawing Figures

LIQUID FEEDING MEANS FOR STEAM-PRODUCING APPLIANCE

This invention relates to a liquid feeding means for a steam-producing appliance. More particularly, the invention relates to an appliance of the type in which an absorbent wick saturated with a liquid is contacted by the heater element heated to a temperature sufficient to instantaneously convert liquid in the portion of the wick contacted by the heater into steam.

The invention will be described in connection with a steam-producing curling iron. However, it is to be understood that the invention may be used advantageously with other types of steam-producing appliances, such as a facial sauna.

In certain steam-producing curling irons, the absorbent wick is located within a liquid-containing reservoir, a portion of the wick being exposed outside the reservoir for engagement by the heater element. It has been found that as liquid is evaporated from the exposed portion of the wick, during steam-production, little or no air flows back through the wick into the reservoir, probably because the wick is saturated with liquid As a result, no air is available to replace the liquid drawn from the reservoir, and a partial vacuum develops within the reservoir. As a result, long before all the liquid in the wick and reservoir has been converted to steam, steam production halts because the water does not continue to flow to the exposed portion of the wick.

It is an object of the present invention to overcome this problem by providing a liquid feeding means having means for transmitting air through the wick into the reservoir.

It is another object of the invention to provide a liquid feeding means in which the wick is conveniently provided with an air transmitting means in the form of a capillary tube embedded in the wick.

Additional objects and features of the invention will be apparent from the following description, in which reference is made to the accompanying drawings.

Figure 1:
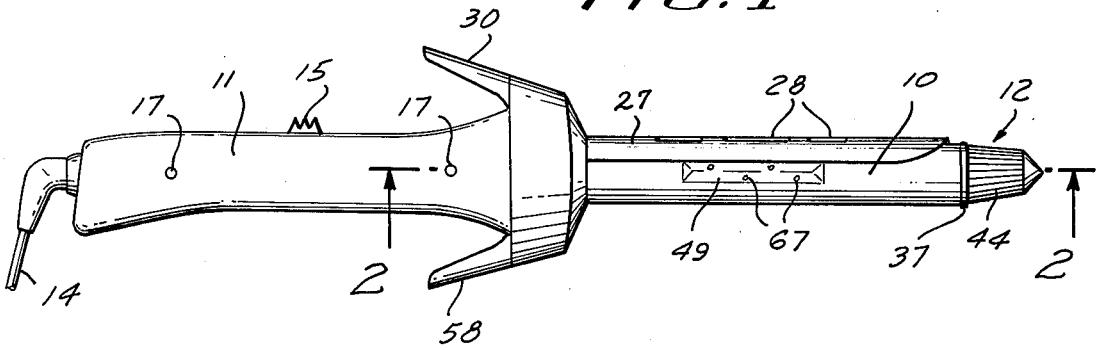
FIG. 1 is a side elevational view of a steam-producing curling iron, as an example of an appliance which may incorporate a liquid feeding means according to the present invention.

The curling iron chosen to illustrate the present invention comprises a cylindrical tubular barrel 10 having a handle 11 at one end and a reservoir 12 at the other end. At the end of handle 11 which joins barrel 10, the handle is formed with an enlarged collar portion 13, and extending from the opposite end of handle 11 is an electric power cord 14. The free end of power cor 14 is provided with the usual plug (not shown) for insertion into an electrical receptacle to provide electric power to the curling iron. On handle 11 is a switch 15, for energizing and deenergizing a heating member within barrel 10. Handle 11 and collar 13 are made in two parts, preferably of molded plastic, the parts being joined along a longitudinal line of separation and held together by screws 17.

Extending along most of the length of barrel 10 is a clamp 27, which may be formed of thin metal, having an arcuate transverse shape so that it conforms to the external contour of barrel 10. Clamp 27 is formed with elongated openings 28 which permit the flow of steam through the clamp. One end of clamp 27 is fixed by screws 29 to a lever 30 pivotally mounted in collar 13 about an axis perpendicular to the longitudinal axis of barrel 10. When lever 30 is depressed, clamp 27 pivots away from barrel 10 so that the end of a lock of hair to be curled can be placed between the barrel and clamp. Lever 30 is then released, and a spring 33 returns clamp 27 toward barrel 10. As a result, the end of the lock of hair is gripped between clamp 27 and the barrel, and the remainder of the lock of hair can then be wound around the barrel and clamp simply by rotating the curling iron around the longitudinal axis of barrel 10.

Fixed within the end of barrel 10, opposite handle 11, is a sleeve 36 forming part of reservoir 12. At one end, sleeve 36 is formed with a shoulder 37 of larger diameter than barrel 10. When the parts are assembled, shoulder 37 engages the end of barrel 10 thereby defining the assembled relationship between two parts. Spaced inwardly from shoulder 37, sleeve 36 is formed with a detent 38 which snaps into a rectangular hole 39 in barrel 10 when the sleeve and barrel are assembled. The cooperation between detent 38 and hole 39 prevents sleeve 36 from moving out of barrel 10. Thus, the cooperation of shoulder 37 and detent 38 with barrel 10 maintains sleeve 36 stationary with respect to barrel 10.

The internal bore of sleeve 36 is reduced in diameter at its innermost end, and at this point the sleeve grips a wick 40 of absorbent material. The inner end 71 of wick 40 projects past sleeve 36 and is exposed within the interior of barrel 10. The major portion of wick 40 extends axially through and beyond the bore within sleeve 36. Adjacent to its innermost end, the bore within sleeve 36 is formed with an internal screw thread.

Reservoir 12 also comprises a tube 43 having an external screw thread at its inner end adapted to cooperate with the screw thread in sleeve 36. At its outer end, tube 43 has a cap 44 fixed to it in a permanent manner. To fill reservoir 12, cap 40 is rotated so as to unscrew tube 43 from sleeve 36, thereby permitting the cap and tube to be removed from the sleeve. Tube 43 is then filled with a suitable liquid, such as water, and the tube is inserted and screwed into sleeve 36 until the parts reach the position shown in FIG. 2. Wick 40 absorbs the liquid and carries it to the innermost end 71 of the wick exposed within barrel 10.

Axially slidable within barrel 10 is a heating member comprising a tube 47 carrying within it an electrically-heated element 48. Heater element 48 projects beyond the end of tube 47 toward wick 40. Movement of tube 47 within barrel 10 is guided by four elongated depressions 49 formed in barrel 10. Movement is also guided by two diametrically opposed elongated slots 50 in tube 47 which slidably accommodate a post 22 molded integrally with collar 13.

Surrounding tube 47 is a sealing ring 51 which moves with tube 47 and has a sliding enegagement with the inner surface of barrel 10. Sealing ring 51 engages barrel 10 along a continuous line and hence prevents liquid within the barrel from flowing past the sealing ring into handle 11 where it might interfere with electrical components housed within the handle. A plug 52 fits frictionally within the end of tube 47 closest to handle 11, and electrical wires (not shown) pass through two holes in plug 52 and into tube 47 to carry electric current to heater element 48. A compression coil spring 54 is arranged between sleeve 36 and heating member 47, 48 one end of spring 54 surrounding a boss 55 projecting from sleeve 36, and the other end of spring 54 surrounding heater element 48 and bearing against the end of tube 47.

Handle 11 carries an actuator means in the form of a lever 58 pivoted within collar 13 about an axis perpendicular to the longitudinal axis of barrel 10. A U-shaped bracket 61 is fixed by screw 62 to the end of lever 58 located within collar 13. A link in the form of a bent wire 63 pivotally connects each arm of bracket 61 to plug 52. More specifically, one end of each link 63 fits pivotally through a hole in its respective arm of bracket 61, and the other end of link 53 fits into a hole in cap 52.

Figure 2:
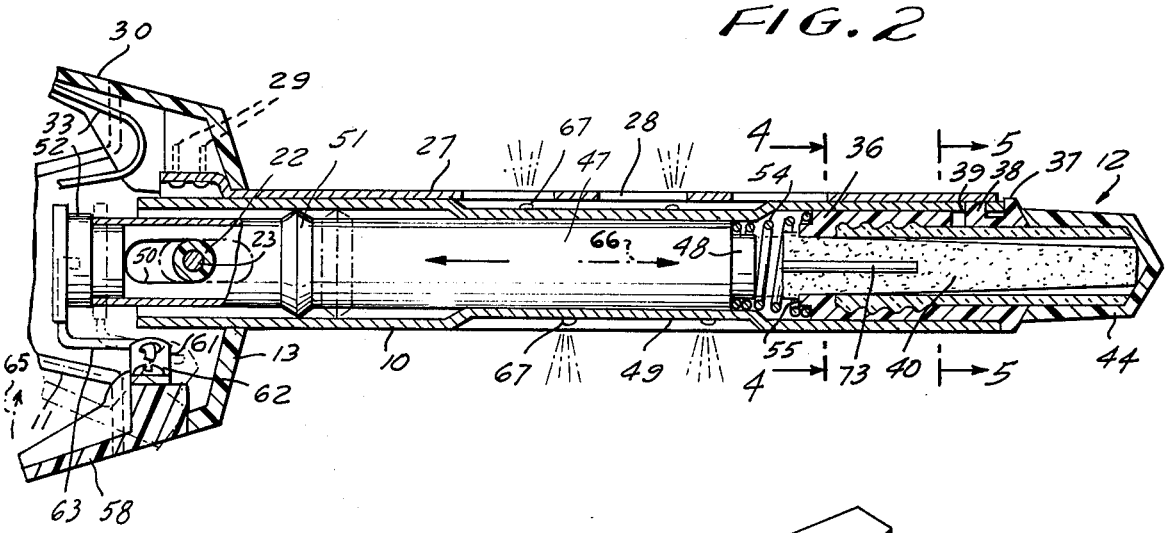
FIG. 2 is a fragmentary longitudinal cross-sectional view on an enlarged scale, showing two positions of a heating member within the curling iron barrel.

FIG. 2 illustrates in solid lines the position of the parts when no steam is desired. Lever 58 is not actuated, and hence spring 54 maintains tube 47 in its retracted position defined by engagement of one end of each slot 50 with post 22. In this condition, heater element 48 is spaced from wick 40. When steam is desired, lever 58 is depressed in the direction of arrow 65 to its broken line position. This movement is transmitted by links 63 to cap 52 in the end of tube 47, thereby moving tube 47 in the direction of arrow 66 against the force of spring 54. This movement brings heater element 48 into engagement with wick 40 as shown in broken lines. As a result of this engagement, the liquid carried by wick 40 is immediately converted into steam within barrel 10. The steam flows out of barrel 10 through holes 67 formed in the barrel in the region of depressions 49. The steam is of course applied to hair wound around barrel 10 and clamp 27. When production of steam is to be terminated, lever 58 is simply released allowing spring 54 to return rube 47 from its advanced position shown in broken lines to its retracted position shown in sold lines.

Figure 3:
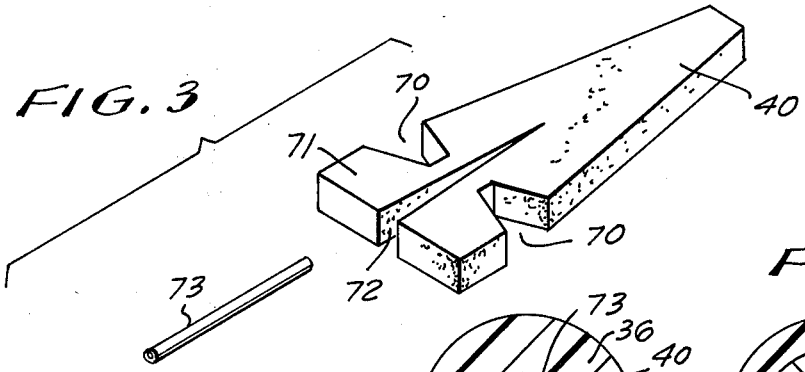
FIG. 3 is an exploded perspective view of a wick and capillary tube.

In the present example, wick 40, which may be formed of felt or any other suitable absorbent material, has an elongated, truncated triangular shape, best seen in FIG. 3. Near its wider end, wick 40 is provided with two peripheral notches 70. It is in the region of the notches 70 that wick 40 is gripped by the innermost end of sleeve 36. Therefore, the portion 71 of wick 40 between notches 70 and the wider end of the wick, is the wick portion exposed on the exterior of sleeve 36.

Wick 40 is provided with a longitudinally-extending slit 72 extending from the exposed end of the wick for about one half its length. Longitudinally arranged within slit 72 is a tube 73 having an inner diameter of capillary size. Tube 73 is thus embedded within wick 40, and extends from the exposed portion 71 of the wick toward the interior of the reservoir. Tube 73 may be made of any suitable material, but such a tube formed of woven glass fibers has been found effective.

Due to the capillary nature of tube 73, no liquid from within the wick or reservoir flows out through the tube. However, the tube does transmit air into the reservoir as liquid feeds out of the reservoir along the length of wick 40, due to production of steam.

Figure 4:
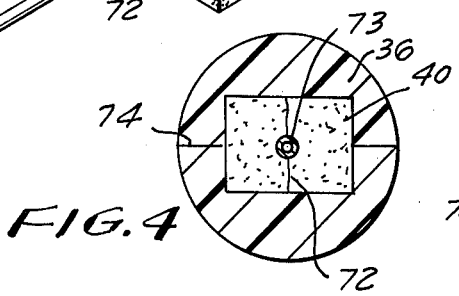
FIG. 4 is a transverse cross-sectional view, on an enlarged scale, taken along line 4—4 of FIG. 2.
Figure 5:
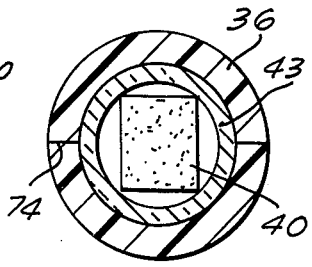
FIG. 5 is a transverse cross-sectional view, on an enlarged scale, taken along line 5—5 of FIG. 2.

In practice, sleeve 36 is formed in two longitudinal halves which are permanently joined, such as by a suitable cement, along a joinder line 74 (FIGS. 4 and 5). Before the two sleeve halves are joined, wick 40 is placed between them. If desired, tube 73 can be placed within slit 72 prior to sandwiching wick 40 between the halves of sleeve 36. Alternatively, tube 73 can remain separate from wick 40 until after the wick is assembled with sleeve 36. Thereafter, tube 73 can be placed upon a tool having an elongated needle-like nose, and by means of the tool the tube can be pushed into slit 72.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A liquid feeding means for a steam-producing appliance, comprising:

a. a reservoir for containing liquid, b. a wick of absorbent material communicating with the interior of said reservoir, a portion of said wick being exposed exteriorly of said reservoir for engagement by a heated element to produce steam, and c. means extending to the exposed portion of said wick for transmitting air through said wick into said reservoir as liquid is evaporated from the exposed portion of said wick to replace liquid drawn out of said reservoir through said wick.

2. A liquid feeding means as defined in claim 1 wherein said air-transmitting means is completely surrounded by said wick, except for a part of said means exposed in the exposed portion of said wick.

3. A liquid feeding means as defined in claim 1 wherein said air-transmitting means includes a tube embedded in said wick and extending from the exposed portion of said wick toward said reservoir.

4. A liquid feeding means as defined in claim 3 wherein said tube has an inside diameter of capillary size.

5. A liquid feeding means as defined in claim 3 wherein said wick is slit from its exposed portion toward said reservoir, and said tube is arranged within said slit.

6. A liquid feeding means as defined in claim 3 wherein one end of said tube is flush with the end of the exposed portion of said wick, the remainder of said tube being embedded in said wick.

* * * * *